US012623274B2

(12) United States Patent
Su

(10) Patent No.: US 12,623,274 B2
(45) Date of Patent: May 12, 2026

(54) METHOD FOR MANUFACTURING GOLF CLUB HEAD WITH SOLE TEXTURES BY PRECISION FORGING

(71) Applicant: Chi-Hung Su, Tainan City (TW)

(72) Inventor: Chi-Hung Su, Tainan City (TW)

( * ) Notice: Subject to any disclaimer, the term of this patent is extended or adjusted under 35 U.S.C. 154(b) by 363 days.

(21) Appl. No.: 18/513,513

(22) Filed: Nov. 18, 2023

(65) Prior Publication Data

US 2025/0162019 A1 May 22, 2025

(51) Int. Cl.
*B21J 13/02* (2006.01)
*A63B 53/04* (2015.01)

(52) U.S. Cl.
CPC ..... *B21J 13/02* (2013.01); *A63B 53/0445* (2020.08); *A63B 53/047* (2013.01)

(58) Field of Classification Search
CPC ..... B21J 5/02; B21J 9/02; B21J 9/022; B21J 13/02; B21K 17/00
See application file for complete search history.

(56) References Cited

U.S. PATENT DOCUMENTS

2004/0138001 A1* 7/2004 Sano ..... A63B 53/0466 473/324
2004/0147343 A1* 7/2004 Billings ..... A63B 53/0466 473/349
2005/0034835 A1* 2/2005 Tsai ..... B21J 5/02 164/76.1
2008/0242441 A1* 10/2008 Chen ..... A63B 60/00 473/329
2019/0111322 A1* 4/2019 Su ..... B21K 17/00

* cited by examiner

*Primary Examiner* — Teresa M Ekiert
(74) *Attorney, Agent, or Firm* — Hershkovitz & Associates, PLLC; Abe Hershkovitz

(57) ABSTRACT

A method for manufacturing a golf club head with sole textures comprises steps of providing and bending a crude rod made of a metallic material, a first forging process for forming a uniaxial tilting blank of a head body via a first forging die, a second forging process for forming a biaxial tilting blank of the head body via a second forging die, and a third forging process for forming a club head with sole textures via a third die. Compared with machining grooves to a sole of the club head, the method is time efficient and cost effective.

6 Claims, 11 Drawing Sheets

METHOD FOR MANUFACTURING GOLF CLUB HEAD WITH SOLE TEXTURES BY PRECISION FORGING

BACKGROUND OF THE INVENTION

1. Field of the Invention

The present invention relates to a method for manufacturing a club head of a golf club, and more particularly to a method for manufacturing a golf club head with sole textures by precision forging.

2. Description of Related Art

A golf club, e.g. an iron golf club, has a club head in a specific appearance. The club head of the golf club is made by casting or forging metallic materials. In order to enhance strike performance of the club heads, in some iron golf clubs, grooves are formed to soles thereof for reducing frictional resistance between the soles of the club heads and the ground, thereby achieving smooth club swing and striking.

In a conventional method for manufacturing a golf club head with sole textures, after a club head is formed, grooves are machined to the sole of the club head by a computer numerical control (CNC) machine.

However, since the appearance of the club head is specified, the club head needs to be held by a fixture for stably fixing on a base of the CNC machine. There is a positioning deviation between the head body and the fixture. In addition, the machined grooves need to be formed to the sole of the club head having a biaxial tilting surface. Consequently, it is difficult to control quality of the machined grooves formed to the sole of the club head, and machining the grooves results in longer processing time and higher manufacturing costs.

To overcome the shortcomings, the present invention tends to provide a method for manufacturing a golf club head with sole textures by precision forging to mitigate or obviate the aforementioned problems.

SUMMARY OF THE INVENTION

The main objective of the invention is to provide a method for manufacturing a golf club head with sole textures by precision forging to solve the problems of longer processing time and higher manufacturing costs for machining grooves to the sole of the golf club head.

The method for manufacturing the golf club head with sole textures by precision forging has steps of providing and bending a crude rod made of a metallic material, a first forging process for forming a uniaxial tilting blank of a head body, a second forging process for forming a biaxial tilting blank of the head body, and a third forging process for forming a club head with sole textures.

In the first forging process for forming a uniaxial tilting blank of a head body, the crude rod being bent is placed in a first forging die of a forging machine and is forged by a single forging press or a multi-forging press to form a uniaxial tilting blank of the head body.

In the second forging process for forming a biaxial tilting blank of the head body, the uniaxial tilting blank of the head body is placed in a second forging die of the forging machine and is forged by a single forging press or a multi-forging presses to form a biaxial tilting blank of the head body.

In the third forging process for forming a club head with sole textures, the biaxial tilting blank of the head body is placed in a third forging die of the forging machine and is forged by a single forging press or a multi-forging press to form a club head having a biaxial tilting striking face and sole textures formed at a sole of the club head.

The method for manufacturing a golf club head with sole textures by precision forging in accordance with the present invention can achieve the following advantages.

1. Manufacturing time and costs for manufacturing a golf club head with textures can be reduced. With three steps of progressive precision forging processes, the crude rod made of a metallic material is firstly forged to form the uniaxial tilting blank of the head body, is secondly forged to form the biaxial tilting blank of the head body, and is finally forged to form the club head with sole textures step by step. The club head can be forged to match precision forging dies and is formed in specific appearance with the sole textures at the same time. The golf club head with sole textures can be efficiently manufactured. The problems of long manufacturing time and high manufacturing costs caused by machining grooves to a sole of the forged golf club head can be solved.
2. Enhancing accuracy and quality of the sole textures of the club head. The club head with sole textures is precisely forged by three steps of progressive precision forging processes with appearance control via precision forging dies and forging temperature control according to each step of the forging process. The sole textures can be precisely formed in shape and in position. The club head can be manufactured with high accuracy and stable high quality.
3. Varying the sole textures via forging dies. The club head is forged to have the sole textures via the third forging die, so the sole textures can be formed in various shapes according to various club heads. The club heads can be produced with stable and reliable qualities.

Other objects, advantages and novel features of the invention will become more apparent from the following detailed description when taken in conjunction with the accompanying drawings.

DETAILED DESCRIPTION OF PREFERRED EMBODIMENT

Figure 1:
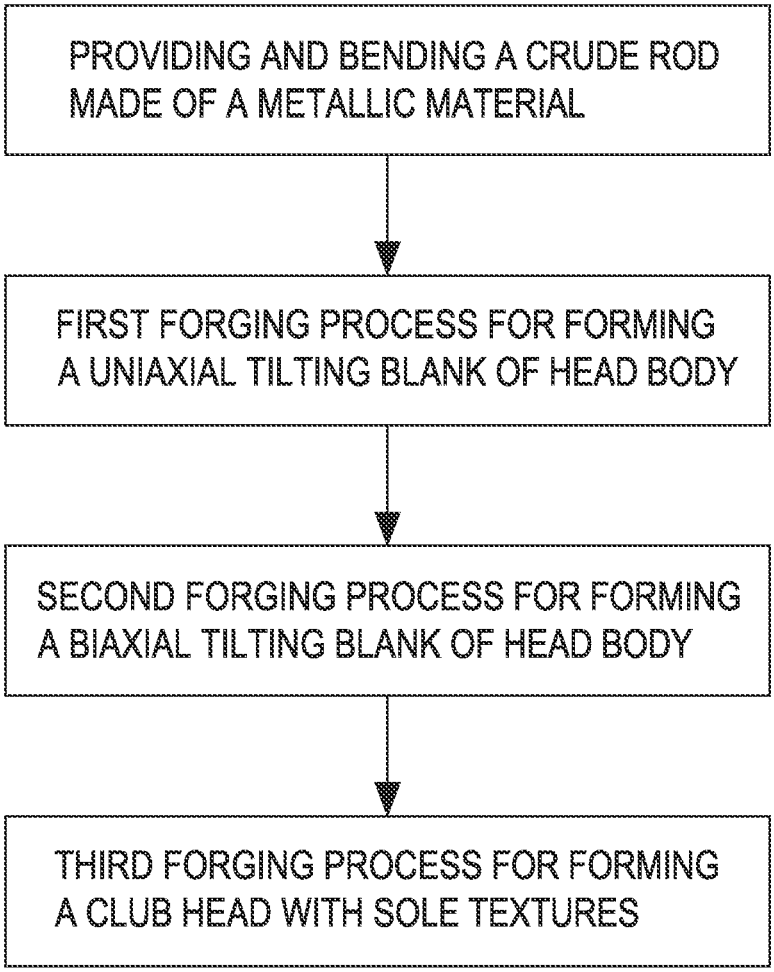
FIG. 1 shows a block diagram of a method for manufacturing a golf club head with sole textures by precision forging in accordance with the present invention.

With reference to FIG. 1, a method for manufacturing a golf club head with sole textures in accordance with the present invention comprises steps of providing and bending a crude rod made of a metallic material, a first forging process for forming a uniaxial tilting blank of a head body, a second forging process for forming a biaxial tilting blank of the head body, and a third forging process for forming a club head with sole textures.

In the step of providing and bending a crude rod made of a metallic material, the metallic material of the crude rod may be selected from carbon steel, stainless steel or other metallic materials. Said carbon steel can be selected from American Iron and Steel Institute and Society of Automotive Engineer (ASIS-SAE) numbers 1020C, 1025C, 1035C, 1045C, and 35CrMo according to carbon content or alloy composition. Said stainless steel may be selected from Japanese Industrial Standards (JIS) numbers SUS303, SUS304, SUS431, and 17-4PH according to alloy compositions.

Figure 2:
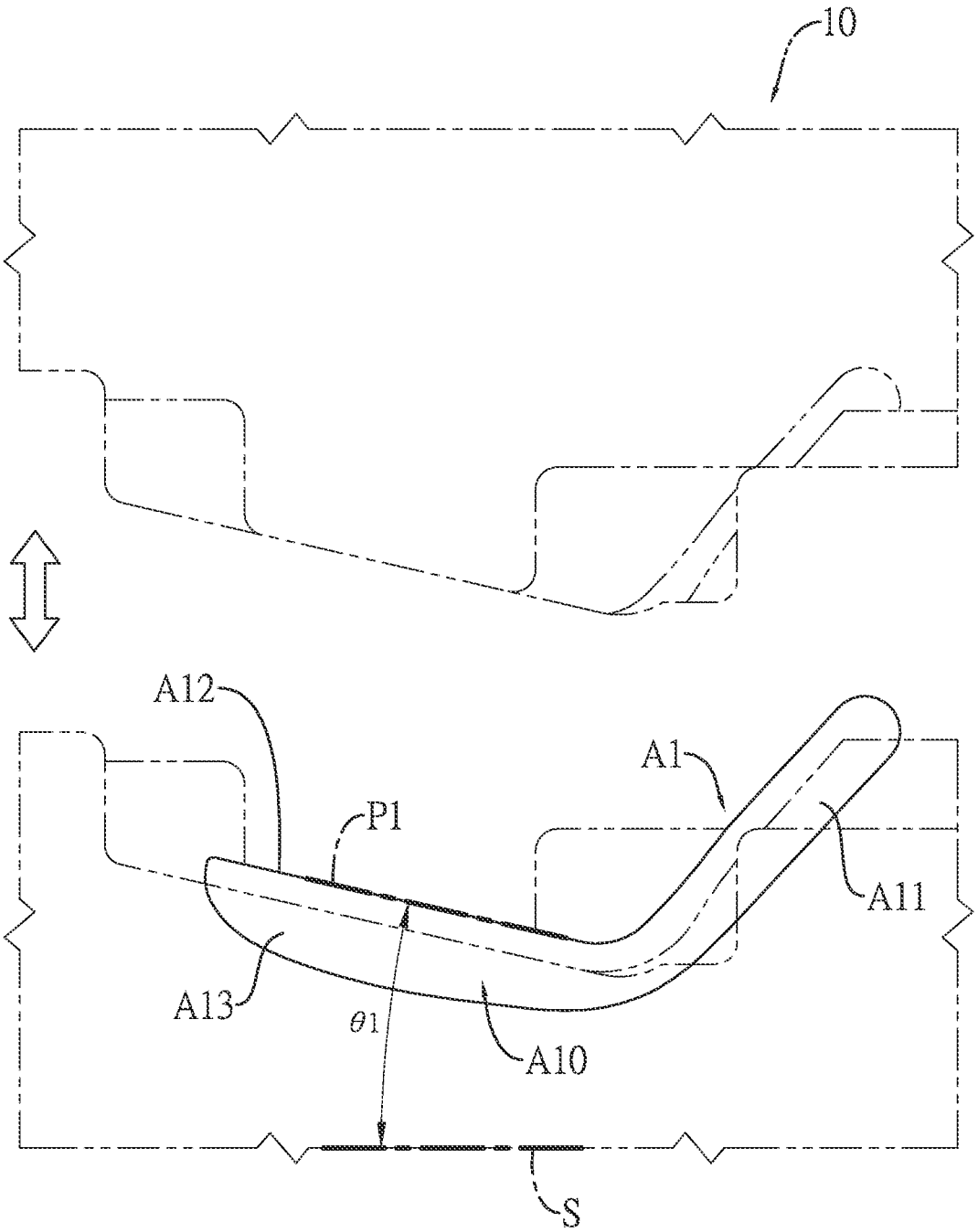
FIG. 2 shows an operational elevation view of a step of a first forging process for forming a uniaxial tilting blank of a head body of the method via a first forging die.
Figure 3:
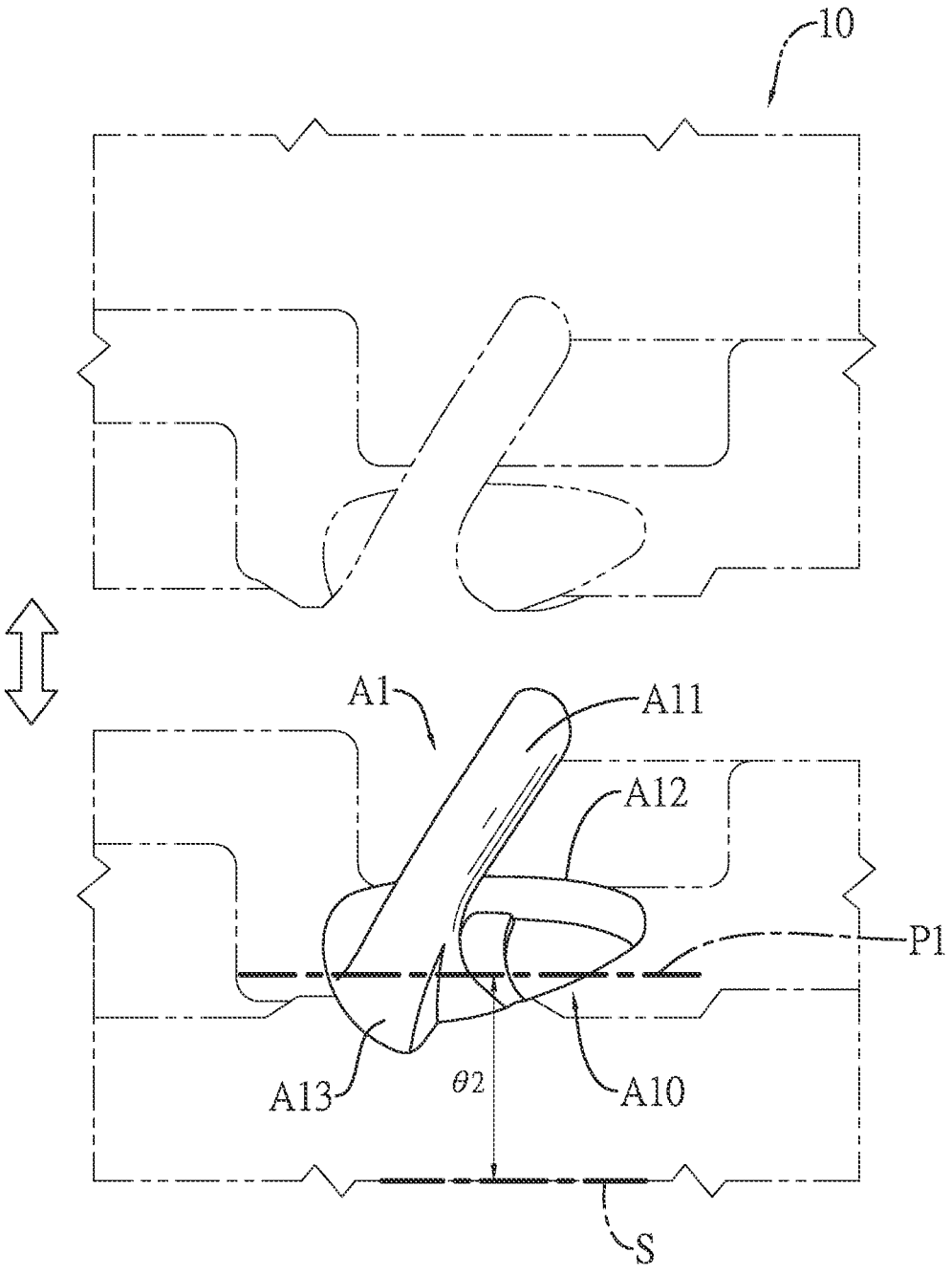
FIG. 3 shows another operational elevation view of the step of the first forging process for forming a uniaxial tilting blank of a head body of the method in FIG. 2.

With reference to FIGS. 2 and 3, in the first forging process for forming a uniaxial tilting blank of a head body A1, the bending crude rod is placed in a first forging die 10 of a forging machine and is forged by a single forging press or a multi-forging press to form a uniaxial tilting blank of the head body A1. The uniaxial tilting blank of the head body A1 has a blank base A10 with a blank face A12 and a hosel portion A11 obliquely formed at a side of the blank base A10. The blank base A10 has a sole A13 and a first datum plane P1 being parallel to the blank face A12. A first axis and a second axis being perpendicular to each other are defined in a reference datum S of the forging machine. A first inclined angle θ1 is formed between the first datum plane P1 and the first axis and ranges from 3 degrees to 25 degrees. A second inclined angle θ2 is formed between the first datum plane P1 and the second axis and is 0 degree. In the first forging process for forming a uniaxial tilting blank of a head body A1, a forging temperature is controlled to range from 700° C. to 1100° C. The forging temperature may be adjusted according to the metallic material of the crude rod. In the embodiment, the first inclined angle θ1 ranges from 3 degrees to 15 degrees. The forging temperature ranges from 900° C. to 1100° C.

Figure 4:
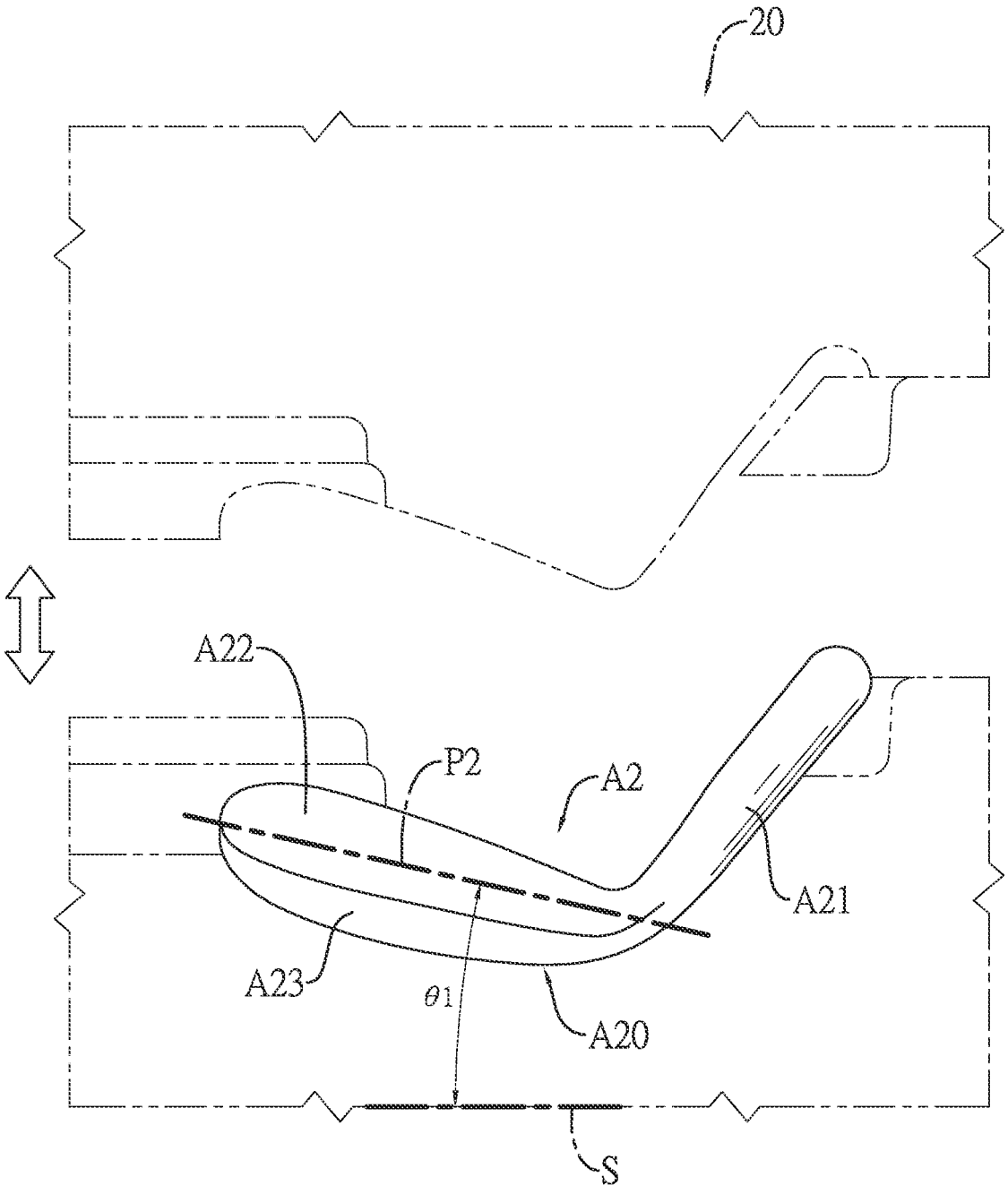
FIG. 4 shows an operational elevation view of a step of a second forging process for forming a biaxial tilting blank of the head body of the method via a second forging die.
Figure 5:
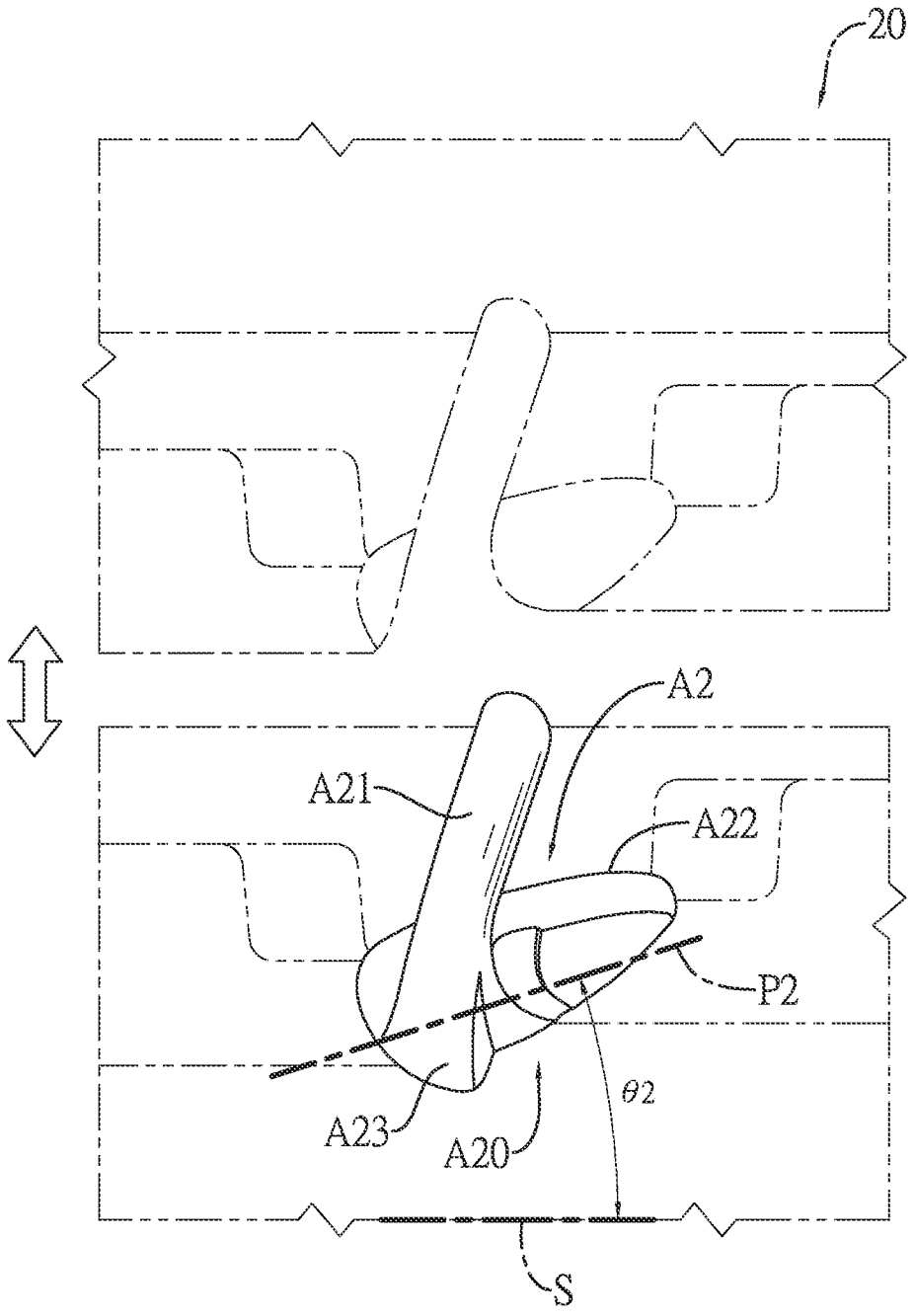
FIG. 5 shows another operational elevation view of the step of the second forging process for forming a biaxial tilting blank of the head body of the method in FIG. 4.
Figure 6:
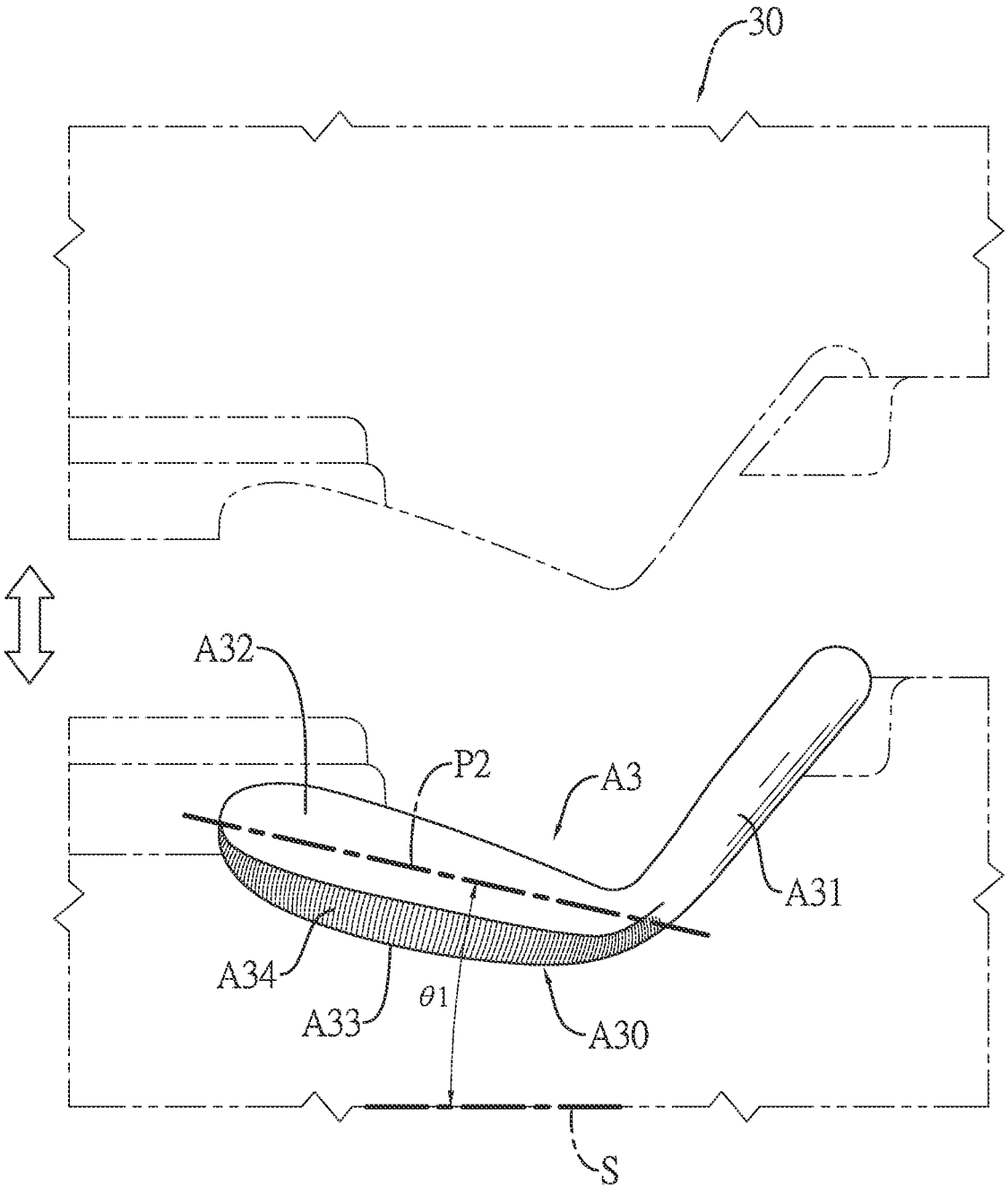
FIG. 6 shows an operational elevation view of a step of the third forging process for forming a club head with sole textures of the method via a third forging die.
Figure 7:
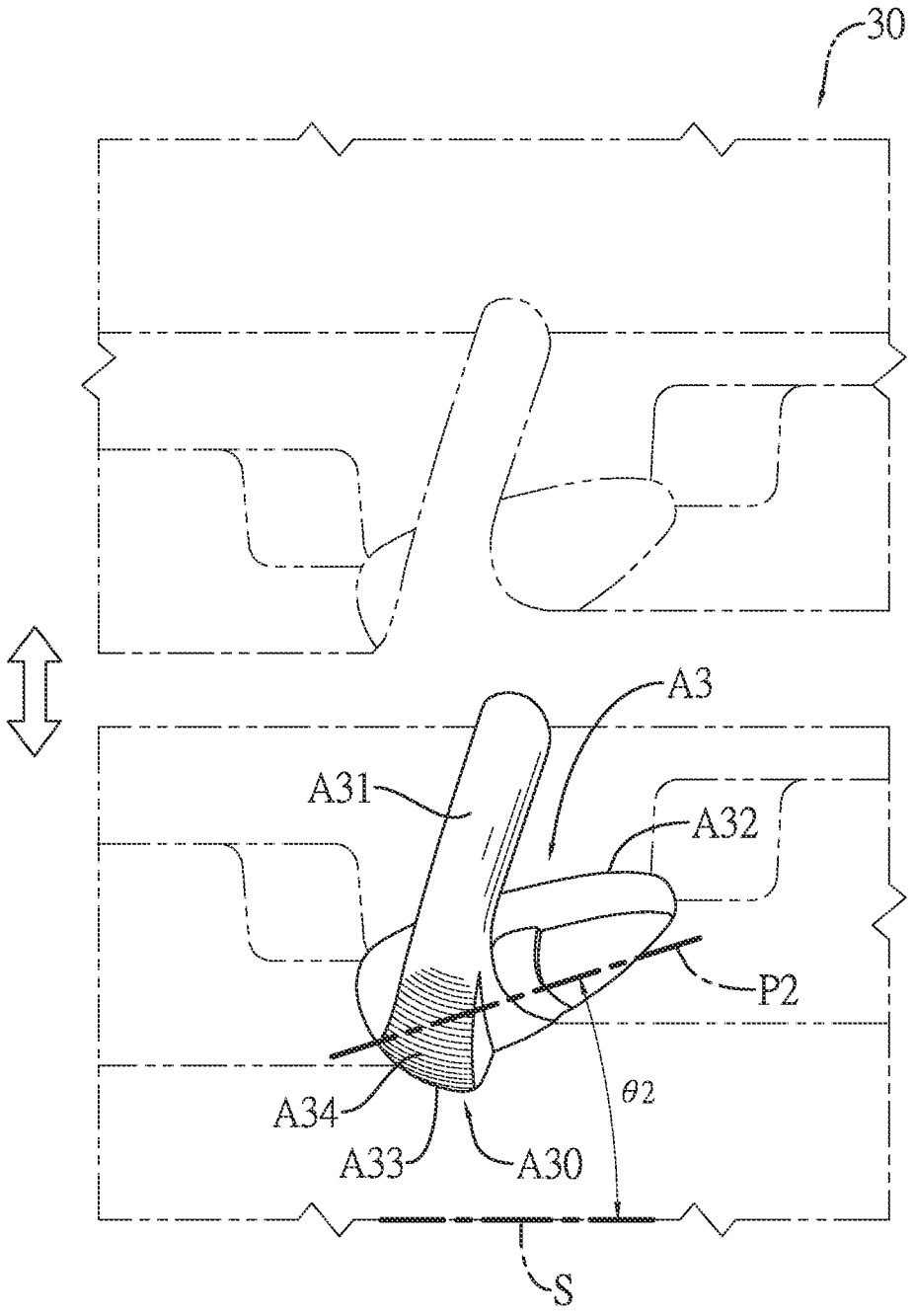
FIG. 7 shows another operational elevation view of the step of the third forging process for forming a club head with sole textures of the method in FIG. 6.

With reference to FIGS. 4 and 5, in the step of the second forging process for forming a biaxial tilting blank of the head body A2, the uniaxial tilting blank of the head body A1 is placed in a second forging die 20 of the forging machine and is forged by a single forging press or a multi-forging press to form a biaxial tilting blank of the head body A2. The biaxial tilting blank of the head body A2 has a head base A20 and a hosel portion A21 obliquely formed at a side of the head base A20. The head base A20 has a striking panel with a striking face A22, a sole A23 located behind a lower part of the striking panel, and a second datum plane P2 being parallel to the striking face A22. A first inclined angle θ1 is formed between the second datum plane P2 and the first axis in the reference datum S and ranges from 3 degrees to 25 degrees. A second inclined angle θ2 is formed between the second datum plane P2 and the second axis in the reference datum S being perpendicular to the first axis and ranges from 3 degrees to 28 degrees. In the second forging process for forming a biaxial tilting blank of a head body A2, a forging temperature is controlled to range from 700° C. to 1100° C. The forging temperature may be adjusted according to the metallic material of the crude rod. In the embodiment, the first inclined angle θ1 ranges from 3 degrees to 15 degrees. The forging temperature ranges from 900° C. to 1100° C.

With reference to FIGS. 6 to 9, in the third forging process for forming a club head A3 with sole textures A34, the biaxial tilting blank of the head body A2 is placed in a third forging die 30 of the forging machine and is forged by a single forging press or a multi-forging presses to form a club head A3 with a biaxial tilting striking face. Substantially, the club head A3 is similar to the biaxial tilting blank of the head body A2 and has a head base A30 and a hosel portion A31 obliquely formed at a side of the head base A30. The head base A30 has a striking panel with the striking face A32. A sole A33 is located behind a lower part of the striking panel. A datum plane is same as the second datum plane P2 of the head base A20 of the biaxial tilting blank of the head body A2 and is parallel to the striking face A32. A first inclined angle θ1 is formed between the datum plane and the first axis in the reference datum S and ranges from 3 degrees to 25 degrees. A second inclined angle θ2 is formed between the datum plane and the second axis in the reference datum S being perpendicular to the first axis and ranges from 3 degrees to 28 degrees. In addition, sole textures A34 are formed to the sole A33 of the club head A3. In the step of the third forging process for forming a club head A3 with sole textures A34, a forging temperature is controlled to range from 700° C. to 1100° C. The forging temperature may be adjusted according to the metallic material of the crude rod. In the embodiment, the first inclined angle θ1 ranges from 3 degrees to 15 degrees. The forging temperature ranges from 700° C. to 1000° C.

Figure 8:
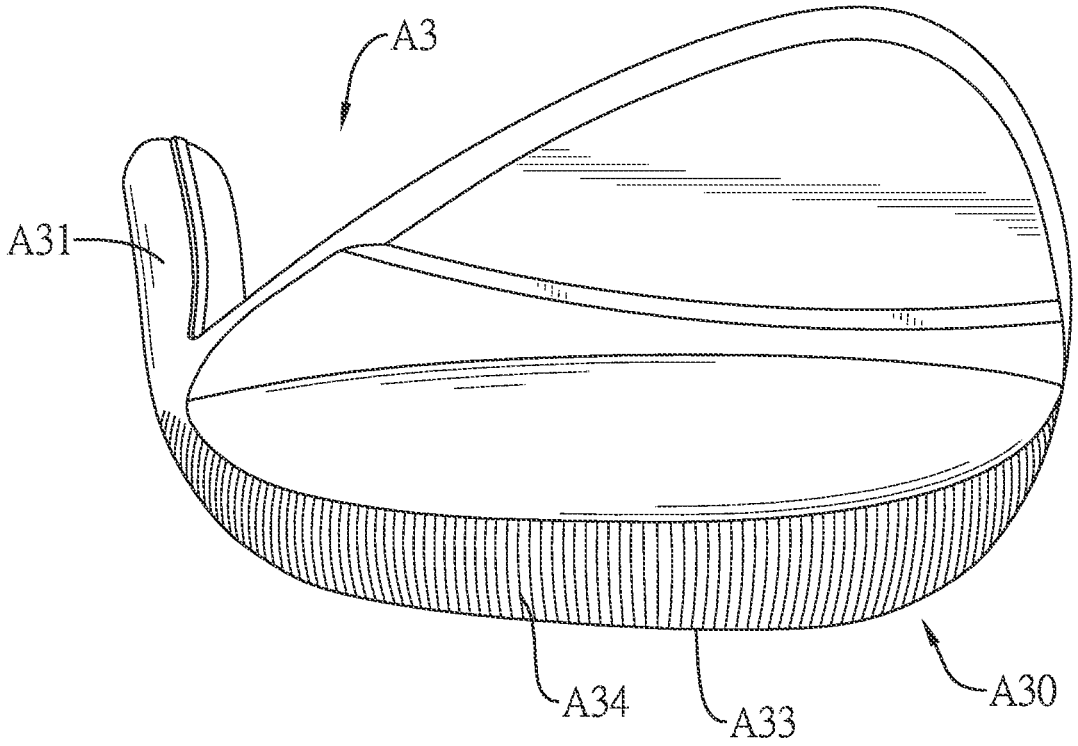
FIG. 8 shows an elevation view of a golf club head manufactured by the method in FIG. 1.
Figure 9:
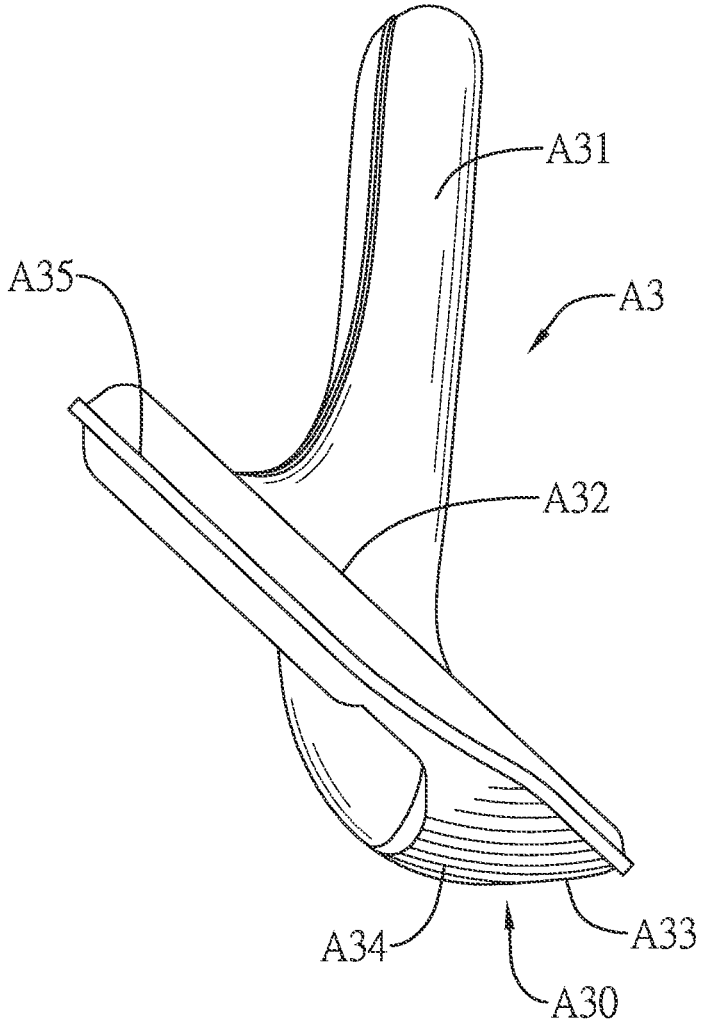
FIG. 9 shows another elevation view of the golf club head manufactured by the method in FIG. 8.
Figure 10:
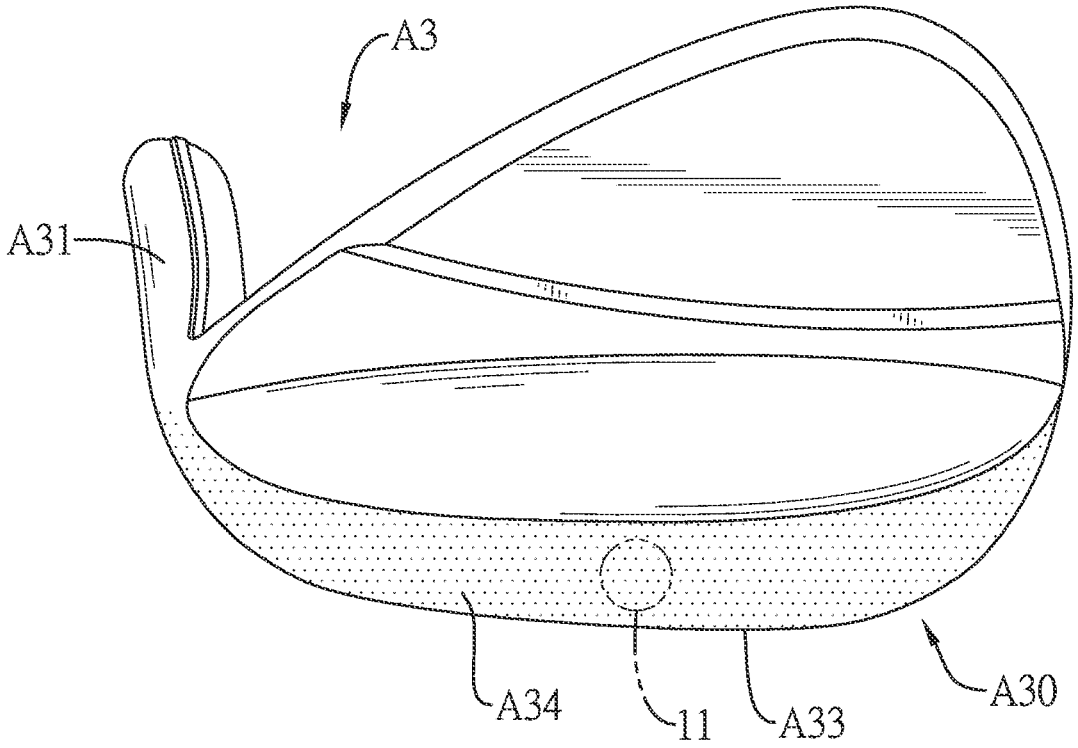
FIG. 10 shows an elevation view of another embodiment of a golf head manufactured by the method in FIG. 1.
Figure 11A:
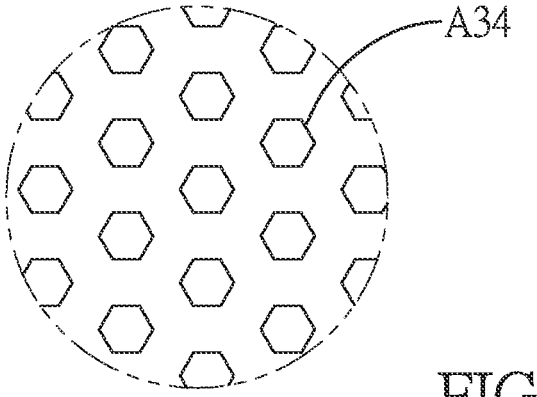
FIGS. 11A, 11B, and 11C are enlarged schematic views of the golf head within circle "11" shown in FIG. 10.
Figure 11B:
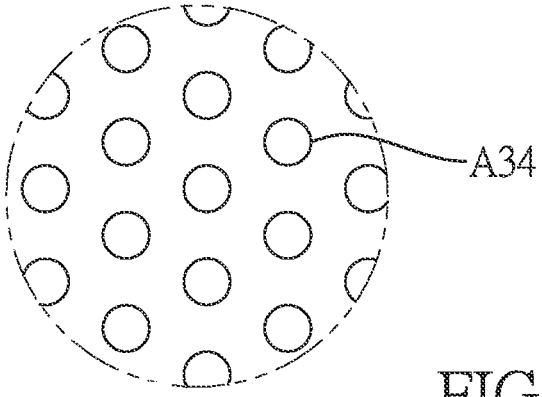
Figure 11C:
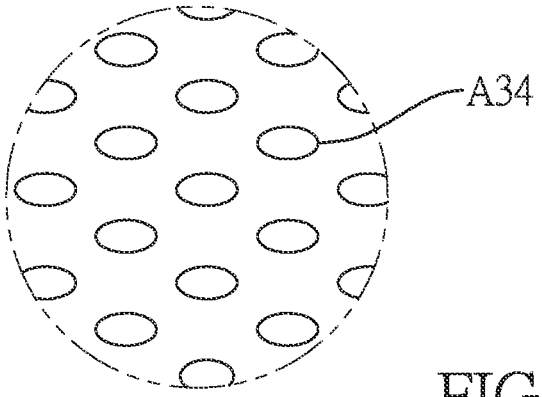

In the second forging process for forming a biaxial tilting blank of the head body A2, a parting line of the biaxial tilting blank of the head body A2 is modified by the second forging die 20 to reach a bottom edge of the striking face A22 from a middle of the lower part of the striking panel. Therefore, in the third forging process for forming a club head A3 with sole textures A34, a region of the sole textures A34 can be adjacent to the bottom edge of the striking face A32. The sole textures A34 may include multiple stripes spaced apart from one another as shown in FIGS. 8 and 9. With reference to FIGS. 10, 11A, 11B, and 11C, in other embodiments, the sole textures A34 may include multiple round dimples spaced apart from one another as shown in FIG. 11B, multiple oval dimples spaced apart from one another as shown in FIG. 11C, or multiple polygonal dimples (e.g. triangular dimples, tetragonal dimples, pentagonal dimples, hexagonal dimples, octagonal dimples, etc.) spaced apart from one another as shown in FIG. 11A, or dimples in other geometric shapes.

The method for manufacturing a golf club head with sole textures in accordance with the present invention further comprises a step of deburring by grinding after the step of the third forging process for forming a club head with sole textures. In the step of deburring by grinding, excess flashes of the club head A3 such as parting line or burrs are removed by grinding. After that, the club head A3 is surface treated to form a predetermined club head A3.

The method for manufacturing a golf club head with sole textures in accordance with the present invention comprises three steps of progressive precision forging processes that the crude rod made of a metallic material is firstly forged to form the uniaxial tilting blank of the head body A1, is secondly forged to form the biaxial tilting blank of the head body A2, and is finally forged to form the club head A3 with sole textures A34 step by step. Therefore, the appearance of the club head A3 can be controlled with precision forging dies, wherein the sole textures A34 of the club head A3 can be precisely formed in various shapes according to various club heads and precisely formed in position. Accordingly, the golf club heads can be mass produced with stable high qualities.

What is claimed is:

1. A method for manufacturing a golf club head with sole textures by precision forging, the method comprising steps of:

providing and bending a crude rod made of a metallic material;

a first forging process for forming a uniaxial tilting blank of a head body of a golf club head, wherein the crude rod being bent is placed in a first forging die of a forging machine and is forged by a single forging press or a multi-forging press to form the uniaxial tilting blank of the head body;

a second forging process for forming a biaxial tilting blank of the head body, wherein the uniaxial tilting blank of the head body is placed in a second forging die of the forging machine and is forged by a single forging press or a multi-forging press to form the biaxial tilting blank of the head body;

a third forging process for forming a club head with sole textures, wherein the biaxial tilting blank of the head body is placed in a third forging die of the forging machine and is forged by a single forging press or a multi-forging press to form the club head having a biaxial tilting striking face and sole textures formed at a sole of the club head, wherein in the first forging process for forming a uniaxial tilting blank of a head body, the uniaxial tilting blank has a blank base having a blank face and a first datum plane being parallel to the blank face, a first axis and a second axis are perpendicular to each other and are defined in a reference datum of the forging machine, a first inclined angle is formed between the first datum plane and the first axis and ranges from 3 degrees to 25 degrees, and a second inclined angle is formed between the first datum plane and the second axis and is 0 degree; and in the step of the second forging process for forming a biaxial tilting blank of a head body, the biaxial tilting blank of the head body has a head base including a striking panel with a striking face, a sole is located behind a lower part of the striking panel, and a second datum plane is parallel to the striking face; a first inclined angle is formed between the second datum plane and the first axis defined in the reference datum and ranges from 3 degrees to 25 degrees, and a second inclined angle is formed between the second datum plane and the second axis defined in the reference datum and is perpendicular to the first axis and ranges from 3 degrees to 28 degrees.

2. The method as claimed in claim 1, wherein in the second forging process for forming a biaxial tilting blank of a head body, a parting line of the biaxial tilting blank of the head body is modified by the second forging die to reach a bottom edge of the striking face from a middle of the lower part of the striking panel; and in the third forging process for forming a club head with sole textures, a region of the sole textures is adjacent to the bottom edge of the striking face.

3. The method as claimed in claim 2, wherein in the first forging process for forming a uniaxial tilting blank of a head body, a forging temperature for the first forging process ranges from 700° C. to 1100° C.;

in the second forging process for forming a biaxial tilting blank of the head body, a forging temperature for the second forging process ranges from 700° C. to 1100° C.; and in the third forging process for forming a club head with sole textures, a forging temperature for the third forging process ranges from 700° C. to 1100° C.

4. The method as claimed in claim 3, wherein in the third forging process for forming a club head with sole textures, the sole textures include multiple stripes, multiple round dimples, multiple oval dimples, or multiple polygonal dimples spaced apart from one another.

5. The method as claimed in claim 1, wherein in the first forging process for forming a uniaxial tilting blank of a head body, a forging temperature for the first forging process ranges from 700° C. to 1100° C.;

in the second forging process for forming a biaxial tilting blank of the head body, a forging temperature for the second forging process ranges from 700° C. to 1100° C.; and in the third forging process for forming a club head with sole textures, a forging temperature for the third forging process ranges from 700° C. to 1100° C.

6. The method as claimed in claim 5, wherein in the third forging process for forming a club head with sole textures, the sole textures include multiple stripes, multiple round dimples, multiple oval dimples, or multiple polygonal dimples spaced apart from one another.

* * * * *